United States Patent [19]

Wilkes

[11] 4,288,207

[45] Sep. 8, 1981

[54] APPARATUS FOR PRODUCING MELT-SPUN FILAMENTS

[75] Inventor: William W. Wilkes, Florence, S.C.

[73] Assignee: Fiber Industries, Inc., New York, N.Y.

[21] Appl. No.: 164,425

[22] Filed: Jun. 30, 1980

[51] Int. Cl.[3] ..... B29C 25/00

[52] U.S. Cl. ..... 425/72 S; 264/129; 264/176 F; 425/94; 425/382.2

[58] Field of Search ..... 425/72 S, 94, 382.2; 264/237, 176 F, 129

[56] References Cited

U.S. PATENT DOCUMENTS

| | | | |
|---|---|---|---|
| 3,135,811 | 6/1964 | Barnett et al. | 264/176 F |
| 3,628,931 | 12/1971 | Russell | 65/11 W |
| 3,969,462 | 7/1976 | Stofan | 264/210.8 |
| 4,038,357 | 7/1977 | Boyes et al. | 264/176 F |
| 4,204,828 | 5/1980 | Peckinpaugh et al. | 264/176 F |

FOREIGN PATENT DOCUMENTS

| | | | |
|---|---|---|---|
| 53-9293 | 4/1978 | Japan | 264/237 |

OTHER PUBLICATIONS

"Quench Duct Filament Oiling", Chemie Faseru/Textilindustrie, Oct. 1979, pp. 838-842.

*Primary Examiner*—Jay H. Woo
*Attorney, Agent, or Firm*—Roderick B. Macleod

[57] ABSTRACT

Disclosed is a melt-spinning process of the type wherein molten polymer is extruded downwardly through a filter pack and through an annular array of holes of a spinneret to form a circularly arranged group of filaments. Quench gas is delivered downwardly through said pack and spinneret coaxially relative to said row of holes and then redirected and discharged outwardly through the group of filaments. A finish substance is sprayed onto the filaments, and the filaments are gathered and redirected at a guide. The finish spraying comprises the steps of conducting the finish substance through the pack and through the spinneret internally of the flow of quench gas, and discharging the finish substance outwardly from within the group of filaments at a level below the discharge of quench gas.

3 Claims, 1 Drawing Figure

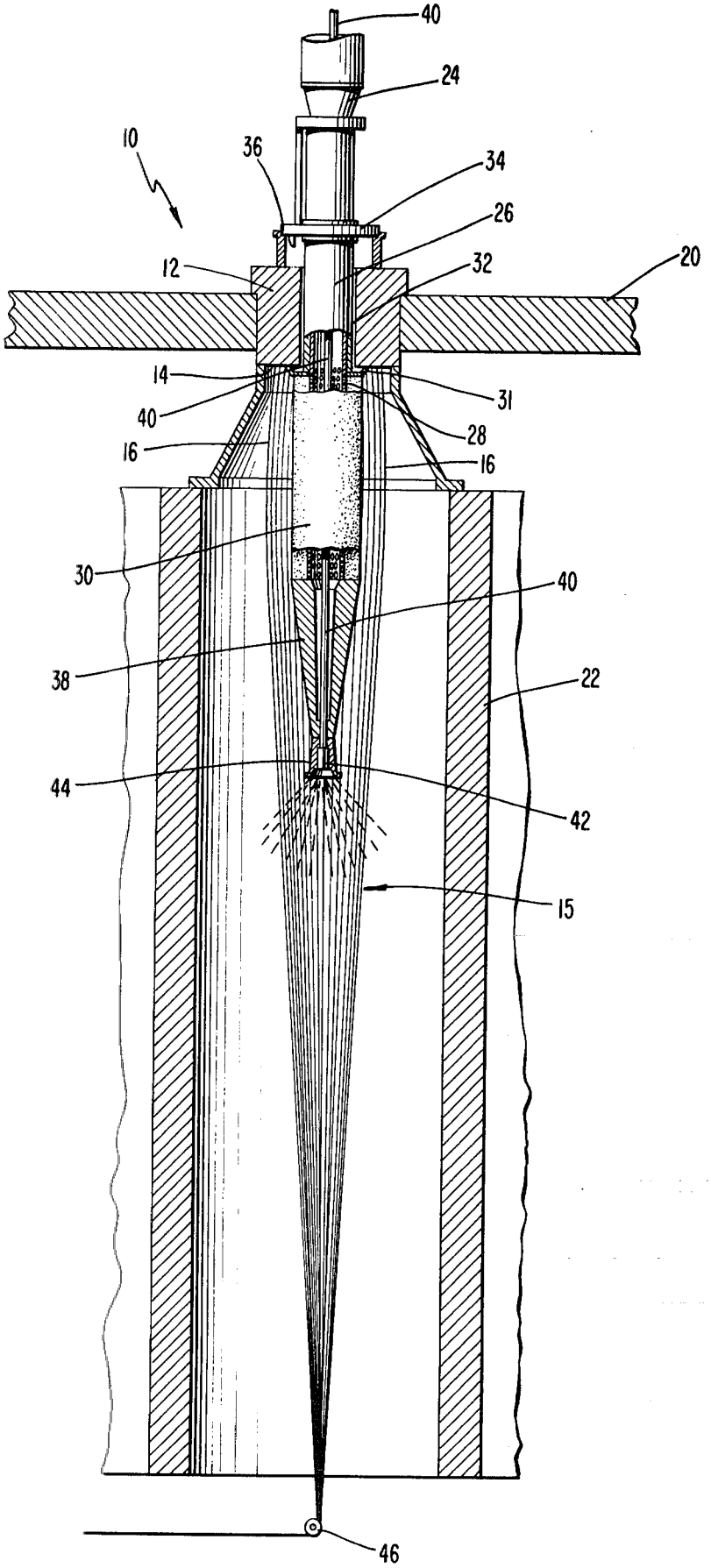
40
24
10
36
34
26
12
32
20
14
31
40
28
16
16
30
40
38
22
44
42
15
46

APPARATUS FOR PRODUCING MELT-SPUN FILAMENTS

BACKGROUND AND OBJECTS OF THE INVENTION

The present invention relates to the manufacture of melt spun polymeric filaments and, in particular, to the application of a finishing liquid to the spun filaments.

The manufacture of melt spun polymeric filaments is typically achieved by extruding a molten polymer, such as polyester, polyamide, etc., through a spinneret and then cooling the filaments thus formed. Therebelow, the filaments are converged and gathered at a guide and delivered to a bobbin or further treatment station. A finishing liquid is applied to the filaments below the quench zone. The finishing liquid may comprise a substance suitable for imparting a desired property to the filaments, such as smoothness, drape, luster, water repellency, flame retardancy, or crease resistance, for example.

The manner in which the filaments are cooled has a significant impact on the resulting quality of the filaments. A typical cooling technique involves a gas quench in which cool air is blown across the filaments as they emerge from the spinneret. In instances where the filaments are extruded in the form of a circular array, it is common to utilize an outflow quench technique in which the filaments are passed downwardly in surrounding relation to an upwardly extending air pipe, the latter being arranged generally coincident with the central axis of the group of filaments. Quench air is directed radially or laterally outwardly through the filament group from an upper, apertured end of the pipe, the air preferably dispersed by a porous sheathing surrounding the apertures. There is thus produced a controlled cooling of the filaments.

In a recent development disclosed in copending application Ser. No. 149,370 of Roland Waite, filed May 13, 1980, a quenching technique has been devised in which quench air is delivered downwardly through the pack and spinneret. This technique has eliminated the elbow below the quenching zone and its accompanying disadvantages.

The application of finishing liquid has heretofore been accomplished, for example, by means of a stationary applicator within which the filaments are gathered. Finishing liquid is caused to flow across the applicator surface and onto the gathered filaments. Another technique involves spraying the finishing liquid onto the filaments which have been gathered at the turning guide. It will be appreciated that the quality of the filaments produced is affected by the uniformity of application of the finishing liquid. The application of the liquid to the filaments when the latter are in a gathered or bunched-up condition is difficult to achieve with the desired uniformity.

It is, therefore, an object of the present invention to minimize or obviate problems of the type discussed above.

Another object of the invention is to provide novel methods and apparatus for the application of finish substance to melt-spun filaments in a more uniform manner.

A further object of the invention is to provide such methods and apparatus without reducing operator accessibility and without hindering filament travel.

BRIEF SUMMARY OF THE INVENTION

These objects and advantages are achieved by the present invention which involves a melt-spinning process of the type wherein molten polymer is extruded downwardly through a filter pack and through a circular row of holes of a spinneret to form a circularly arranged group of filaments. Quench gas is delivered downwardly through the pack and spinneret coaxially relative to the row of holes and then redirected and discharged outwardly through the group of filaments. A finish substance is applied to the filaments, and the filaments are gathered and redirected at a guide. The finish application comprises the steps of, firstly, conducting the finish substance through the pack and through the spinneret and at least partly internally of the flow of quench gas, and, secondly, discharging the finish substance outwardly from within the group of filaments at a level below the discharge of quench gas.

THE DRAWING

The FIGURE is a front view in vertical section of a melt-spinning apparatus according to the present invention.

DETAILED DESCRIPTION OF A PREFERRED EMBODIMENT OF THE INVENTION

The FIGURE generally depicts melt-spinning apparatus described in aforementioned application Ser. No. 149,370, filed May 13, 1980, as modified by the present invention.

In particular, there is depicted a conventional melt-spinning apparatus 10 wherein a conventional filter pack 12 carries a conventional spinneret 14 through which is downwardly extruded a molten polymer such as polyester or polyamide for example, to form filaments. The spinneret is of a conventional type comprising holes arranged in an annular pattern so that a group 15 of circularly arranged filaments 16 is formed. The holes of the spinneret are preferably arranged in a series of circular rows having a common central axis. The spun filaments travel downwardly in converging manner to a stationary guide at which they are gathered and redirected, in conventional fashion.

The pack 12 is mounted on a conventional superstructure 20, and the filaments travel downwardly within a cabinet 22 closed at least on three sides and possibly open at the fourth side for operator monitoring purposes.

Quench gas in the form of air is provided to cool the filaments 15 emerging from the spinneret. The quench gas is delivered by a quench conduit 24 which includes a gas supply portion 26 and a gas discharge portion 28. The gas supply portion 26 extends downwardly through the pack 12 and the spinneret 14 in coaxial relationship with the axis defined by the circular arrays of spinneret holes.

The gas discharge portion 28 is disposed immediately below the spinneret 14 and includes a plurality of outlet openings for discharging the quench air laterally outwardly through the surrounding filaments 16. Preferably, a sheath of porous foam 30 surrounds the conduit discharge portion to uniformly disperse the quench air. A collar 31 may be located on the conduit 24 to position the sheath.

It will be appreciated that quench air passes through the filaments, bellowing them radially outwardly.

The section of the gas supply portion 26 extending through the pack 12 is preferably surrounded by an air gap 32 to minimize heat exchange between the quench gas and molten polymer within the pack 12. Alternatively, or in addition, that section of the gas supply portion 26 could be covered with thermal insulation.

The gas supply conduit 24 includes a fixed stop collar 34 which rests upon a stop shoulder 36 of the pack to support the supply conduit 24 and fixedly locate the latter relative to the spinneret. In this fashion, the spatial relationship between the spinneret holes and the uppermost stream of quench gas is maintained constant, to achieve uniformity of the quenching action and reduce birefringence variance in the filaments produced.

Extending downwardly from the lower end of the discharge portion 28 of the conduit is a gas stream-lining member 38 in the form of a downwardly converging cone. The cone occupies a considerable portion of the space bounded by the converging filaments 16. Air normally drawn downwardly by the rapidly traveling filaments is constrained by the cone to flow in a smoother non-turbulent fashion to minimize undesired vibration of the filaments. The cone 38 can be secured to the lower end of the conduit 28 in any suitable manner, preferably in a releasable manner, such as by screws, bayonet coupling, etc.

It is preferable that the diameter defined by the innermost circular row of holes in the spinneret be at least 7" to allow sufficient room for the gas supply conduit 26 to pass therethrough. Smaller diameters could be employed, but the gas conduit would have to be smaller than needed to conduct an optimum gas flow quantity.

The apparatus disclosed thus far is also described in the aforementioned application Ser. No. 149,370, filed May 13, 1980.

In accordance with the present invention there extends downwardly through the quench conduit 24 and through the air streamlining cone 38, a finish supply conduit 40 which conducts a suitable finishing liquid. The lower end of the finish supply conduit 40 projects beyond the bottom of the cone 38 and carries a spray nozzle 42. The spray nozzle 42 is fixed by a collar 44 and is oriented to spray the finish liquid, in mist form, in a downward and laterally outward direction, so that the liquid passes outwardly through the group of filaments 16 after the latter have been quenched.

It will be understood that the location of the spray nozzle relatively close to the quench zone and high above the usual guide 46, or godet or roll, advantageously affects the uniformity of the finish application. At such location the filaments are not gathered too closely together to inhibit a uniform travel of the finish substance, and are spaced sufficiently near the central axis of the group to receive a concentrated quantity of the sprayed finish.

The presence of the streamlining cone 38 aids in smoothing-out the flow of air in the vicinity of the nozzle, thereby minimizing undesired turbulent swirling actions which could adversely affect the spraying action.

As a result, the filaments receive a substantially uniform application of the finish substance.

Spraying of the finishing substance through the filaments while they are in a separated condition aids not only in achieving a uniform application of finish, but also in augmenting the filament cooling step because the finish substance is typically of a cooler temperature than are the filaments at the disclosed region of finish application.

By locating the finish supply conduit within the quench gas conduit 24, the finish application can be achieved without reducing access space within the cabinet 22 and without inhibiting the travel of the filaments.

In operation, the filaments 16 are formed in circular arrays in conventional fashion. Quench air is conducted downwardly through the pack 12 via the conduit 24 and discharged radially outwardly through the group of filaments to cool the latter. Air currents immediately below the conduit 24 are guided in streamlined fashion by the streamlining cone 38 toward the finish spray nozzle 42. Finish substance is sprayed outwardly from the nozzle and uniformly covers the cooled, still-separated filaments 16. The smooth air flow established by the cone achieves a low turbulence spray pattern to the filaments. Application of the finish spray also aids in further cooling-down the filaments. Thereafter, the filaments are gathered and redirected at the guide 46.

It will be appreciated that the application of finish spray from within the filament group and at a level above the midpoint of the distance between the spinneret and the turning guide promotes a uniformity of the application because of the proximity of the filaments to the longitudinal axis and the still-separated condition of the filaments relative to one another. The air streamlining cone minimizes turbulence in the spray pattern to aid in achieving such uniformity. There is also achieved a final cooling of the filaments.

By conducting the finish substance through the quench gas conduit, operator accessibility within the cabinet is not affected and no hindrance to filament travel is produced.

It is preferable to employ in conjunction with the present invention a circular guide ring beneath the cone and through which the filaments travel. The center of the guide ring would be co-axial with the longitudinal axis of the filament group and would have a diameter less than the diameter which would otherwise be assumed by the filaments. Thus, the guide ring supports the filaments and shortens the free, unsupported length thereof. By so doing, the amplitude of vibration of the filaments is reduced, whereby the filaments are quenched in a more uniform manner. The foregoing guide and its use was invented by another entity.

What is claimed is:

1. In apparatus for the manufacture of melt-spun filaments, said apparatus being of the type wherein molten polymer is extruded downwardly through a filter pack and through an annular array of holes of a spinneret to form a circularly arranged group of filaments, quench gas supply conduits means extending downwardly through said pack and said spinneret coaxially relative to said row of holes, said conduit means including gas discharge means disposed above said guide for discharging quench gas outwardly through the group of filaments, means for applying a finish substance onto said filaments, and a guide below said finish applying means for gathering and redirecting the filaments, the improvement wherein said finish applying means comprises finish supply conduit means extending downwardly through said pack and said spinneret within said quench gas supply conduit means, said finish supply conduit means projecting below said gas discharge means coaxially within the group of filaments and including a means for discharging finish outwardly onto the filaments wherein said finish discharge means is disposed above the midpoint of the distance between said spinneret and said guide.

2. Apparatus according to claim 1, wherein said finish discharge means comprises a nozzle for spraying the finish outwardly onto the filaments.

3. Apparatus according to claim 1 further including a downwardly converging streamlining member disposed between said quench discharge and said nozzle for guiding air downwardly in a generally non-turbulent manner.

* * * * *